United States Patent [19]

Kusaba et al.

[11] Patent Number: 4,958,509

[45] Date of Patent: Sep. 25, 1990

[54] ROLLING METHOD FOR PARALLEL-FLANGE STEEL SHAPES

[75] Inventors: Yoshiaki Kusaba, Kobe; Hiroyuki Matoba; Tsuneo Yamada, both of Ibaragi, all of Japan

[73] Assignee: Sumitomo Metal Industries, Ltd., Osaka, Japan

[21] Appl. No.: 409,303

[22] Filed: Sep. 19, 1989

[30] Foreign Application Priority Data

Sep. 20, 1988 [JP] Japan ..... 63-235388

[51] Int. Cl.[5] ..... B21B 1/08

[52] U.S. Cl. ..... 72/225; 72/366.2

[58] Field of Search ..... 72/366, 225, 224

[56] References Cited

U.S. PATENT DOCUMENTS 4,685,319 8/1987 Aoyagi et al. ..... 72/234

FOREIGN PATENT DOCUMENTS 56-111501 9/1981 Japan ..... 72/224

58-135705 8/1983 Japan ..... 72/225

59-16602 1/1984 Japan ..... 72/225

59-133902 8/1984 Japan ..... 72/225

60-76202 4/1985 Japan ..... 72/224

*Primary Examiner*—Lowell A. Larson

*Assistant Examiner*—T. C. Schoeffler

*Attorney, Agent, or Firm*—Burns, Doane, Swecker & Mathis

[57] ABSTRACT

A rolling method for parallel-flange steel shapes is disclosed, which comprises the steps of:

rough rolling a rolling material in a breakdown mill to form a web and two flanges connected to the ends of the web;

performing intermediate rolling to reduce the flanges to substatially their final dimensions; and performing finish rolling in a universal finishing mill to reduce the web height by rolling the outer surfaces of the flanges with vertical rolls without the inner surfaces of the flanges contacting the lateral surfaces of the horizontal rolls of the universal finishing mill.

19 Claims, 6 Drawing Sheets

$t_{f0} < t_{f1} < t_{f2}$, $H_0 < H_1 < H_2$

ROLLING METHOD FOR PARALLEL-FLANGE STEEL SHAPES

BACKGROUND OF THE INVENTION

This invention relates to a rolling method for steel shapes with parallel flanges such as H-beams and channels which are used in building construction and civil engineering.

Steel shapes having parallel flanges, such as H-beams or parallel-flange channels (herebelow referred to as parallel-flange shapes) have conventionally been manufactured almost entirely by rolling. The name of each portion of a parallel-flange shape will be described while referring to FIGS. 1*a* and 1*b*, which are end views of an H-beam and a parallel-flange channel, respectively.

As shown in these figures, both shapes have two parallel flanges 10 which are connected by a web 12 which is integral with the flanges 10. In the case of the H-beam of FIG. 1*a*, the web 12 is joined to the flanges 10 at their centers, and in the case of the channel of FIG. 1*b*, , the web 12 is connected to one end of each flange 10. The length of a flange 10 to its outer ends is called the flange length Lo, and the distance between the outer edges of two flanges 10 is referred to as the web height Ho. The distance from the inner surface of the web 12 to the end of a flange is called the flange inner length So, and the distance between the inner surfaces of two flanges 10 is called the flange inner width Wo. JIS (Japanese Industrial Standards) includes roughly 33 different standard sizes of H-beams with the web heights Ho ranging from 100–900 mm. Consecutive sizes differ from one another in web height by 25–100 mm.

When an H-beam or a channel is manufactured by a conventional rolling method, as shown in FIG. 2, roughing is performed by a breakdown mill 20. Intermediate rolling is then performed by a universal roughing mill group 26 including a universal roughing mill 22 and a two-high edging mill 24. Finally, finishing is performed by a universal finishing mill 28.

During roughing, a heated rolling material such as an ingot or a continuously cast slab is rolled in the grooves of the breakdown mill 20, which is a two-high reversible mill, to form a beam blank.

Intermediate rolling is performed by mill group 26 consisting of the universal roughing mill 22 and the 2-high edging mill 24 to form an intermediate H-beam. Namely, as shown in FIG. 3, which is a schematic end view of the universal roughing mill 22, the web thickness of the intermediate H-beam 31 is decreased by rolling between the horizontal rolls 30 of the universal roughing mill 22, the flange thickness is decreased by rolling between the lateral surface of the horizontal rolls 30 and the vertical rolls 32, and the rough shape is elongated into an intermediate H-beam 31 by several passes. In each pass of intermediate rolling, the ends of the flanges of the intermediate H-beam 31 are reduced by the grooved rolls 42 of the edging mill 40, and a prescribed flange length Lo is produced. This state is shown in FIG. 4, which is a schematic end view.

During finishing rolling, as shown in FIG. 5, in one or more passes through a universal finishing mill 50, the web 56 and the flanges 58 are reduced in thickness by the horizontal rolls 52 and the vertical rolls 54 in the same manner as in the universal roughing mill 22, the outer surface of the flanges is flattened, and the flanges 58 and the web 56 are made perpendicular to one another.

Thus, when using a conventional rolling method, even in finishing rolling, the inner surfaces of the flanges 58 contact the lateral surfaces of the horizontal rolls 52, and the outer surfaces of the flanges 58 contact the vertical rolls 54, just as in the universal roughing mill 22 used for intermediate rolling. The web thickness is also reduced by the horizontal rolls 52 in the same manner as during intermediate rolling. Accordingly, the flange inner width Wo of a rolled H-beam is determined by the width of the horizontal rolls 52 of the universal finishing mill. This fact causes the following problems.

(1) FIG. 6 shows the cross-sectional shapes of three different H-beams of the same series (H 600×200, for example) having the same flange length Lo. Under present standards, for beams in the same series, the flange inner width Wo is constant, so the flange thickness (tfo, tf1, and tf2) is different for beams of different sizes. Furthermore, the web height Ho is different for each beam (Ho, H1, and H2). Namely, $tfo < tf1 < tf2$ and $Ho < H1 < H2$.

The same situation exists with respect to channels of the same series but of different sizes. As shown in FIG. 7, three different channels of the same series have the same inner width Wo, but the web height and the flange thickness of each channel is different.

(2) When rolling shapes having different flange inner widths (Wo), it is of course necessary to change the horizontal rolls of the universal finishing mill. For example, in accordance with JIS, there are 33 different series of H-beams, and in accordance with ASTM, there are 14 different series. In order to manufacture all of these different series of H-beams, at least two horizontal rolls are necessary for each of the 47 different series. At present prices, the cost of all these rolls comes to hundreds of millions of yen. Furthermore, a large and therefore costly building is necessary for the storage of all these rolls, so the investment costs are extremely high.

(3) The horizontal rolls of a single universal finishing mill can roll only 2000 tons/rolling chance ×3 times =6000 tons of a single series of H-beams. This is because the width of a horizontal roll undergoes about 1 mm of wear per 1000 tons of rolling. Even if the width of a roll is effectively used, the widthwise tolerance of a horizontal roll is only about 6 mm. Therefore, after 6000 tons of rolling, several centimeters are cut off the width of a horizontal roll which can no longer be used for a certain series of beam, and it can then be used for rolling the next series of beam having a smaller web height. Compared to rolls used for rolling steel plate, the amount of steel which can be rolled using a single roll is extremely small. This means that the cost of the rolls per ton of rolled product is high.

(4) When the web height Ho is not a standard height, the normal horizontal rolls on the universal finishing machine must be replaced with special horizontal rolls suited to the web height. Therefore, a small lot of beams having a nonstandard web height cannot be manufactured economically, and manufacturers often refuse orders for small lots of nonstandard beams.

In summary, when a conventional rolling method is used to manufacture parallel-flange shapes, the following problems are encountered.

(1) In a universal finishing mill, it is necessary to have a different set of horizontal rolls with dimensions corresponding to the flange inner width Wo of each series which is to be rolled.

(2) In a single rolling chance, only one series can be rolled.

(3) It is necessary to change the rolls for each series.

(4) A large space is necessary for storage of the rolls.

(5) H-beams having a nonstandard web height H cannot be economically manufactured.

(6) The outer dimensions of the web height Ho are not the same for a single series.

(7) The roll cost is a rather large percentage of the manufacturing costs.

In light of these circumstances, particularly in recent years, built-up H-beams, which are manufactured by cutting a steel plate to form three narrower plates and then welding the three narrower plates together, have become increasingly common and are being used in large quantities. The cost of cutting and welding steel plates makes built-up H-beams more expensive than rolled H-beams, but they do not have many of the above-described disadvantages of rolled H-beams. For example, built-up H-beams can be manufactured in any size, and their dimensional accuracy is superior to that of rolled H-beams.

The above circumstances are generally true of rolled channels as well. However, rolled channels have the following unique problems.

Conventionally, H-beams have been used as the principal structural members of steel-frame buildings. However, as the bending modulus of an H-beam is different depending upon whether the bending force is applied parallel to or normal to the the flanges, H-beams are actually not the most suitable members for use as the main structural members of buildings. Therefore, in recent years, members having a box-shaped cross section have come to be used as main structural members instead of H-beams. Box-shaped members for steel-reinforced buildings of moderate height are commonly electric-resistance welded pipes which have been formed into box shapes. However, for high-rise steel reinforced buildings, box-shaped members are formed by welding large channels together into the shape of a box. The ratio of the flange width Lo to the web height Ho (outer dimensions) of the channels used for this purpose is generally 1:2, so the resulting box-shaped members have a square cross section.

As already mentioned with respect to FIG. 7, in a single series (for example, the 400×400 series), there are many different sizes having different flange thicknesses, so even if the flange inner width Wo is constant, the web height Ho is different for each size.

Due to the nature of rolling, it is difficult to remove the bulges 70 which are formed on the outer corners of a channel, so rolled channels are generally used without removing the bulges 70.

In a high-rise steel-reinforced building, the wall thickness of box-shaped members gradually decreases from the bottom to the top of the building. It is common to employ a single series of channels to form the box-shaped members and to gradually decrease the flange thickness from the bottom to the top of the building. However, as the flange thickness decreases, the web height Ho also decreases. Where two channels having a different web height Ho are welded together, there is a step between the two channels along the joint. Furthermore, the size of the bulges 70 on the corners of a channel is different for channels of different sizes, so not only are the bulges 70 unsightly, but they make it difficult to weld two channels together. The same problems occur when channels are used as horizontal girders.

Using a conventional rolling method, if the horizontal rolls of a universal mill are changed for each size of channel, it is possible to maintain the web height Ho constant for a single series of channels. However, as stated above with respect to H-beams, doing so is not economically feasible since it is necessary to have a large number of horizontal rolls and to frequently exchange the rolls.

Japanese Published Unexamined Patent Application No. 61-262403 (1986) discloses a manufacturing method for H-beams which can vary the flange inner width Wo. In that method, after intermediate rolling, the flange inner width Wo is increased using a variable-width rolling mill. Then, during finishing rolling, the flange inner width is finished using segmented rolls. However, an excessive load is applied to the variable-width rolling mill, so that method is difficult to put into practice.

SUMMARY OF THE INVENTION

It is an object of the present invention to provide a rolling method for steel shapes with parallel flanges which can freely vary the inner width of the web and which can form a plurality of different series of steel shapes using the same universal finishing mill in a practical manner.

It is another object of the present invention to provide a rolling method for steel shapes with parallel flanges which can roll at least two series of steel shapes in a universal finishing rolling mill using only a single type of horizontal roll, whereby the number of rolls which must be maintained is decreased.

It is yet another object of the present invention to provide a rolling method for steel shapes with parallel flanges which can form steel shapes having a constant web height but with a varying flange inner width.

It is still another object of the present invention to provide a rolling method for steel shapes with parallel flanges which can easily vary the dimensions of the steel shapes and which can economically form steel shapes having nonstandard external dimensions.

It is a further object of the present invention to provide a rolling method for steel shapes with parallel flanges which can form steel shapes having square outer corners without bulges.

The present inventors performed intermediate rolling of JIS H450×300 H-beams (H440×300×11/18) using the universal roughing mill group (UR) illustrated in FIG. 2. An end view of the roughing mill 22 is shown in FIG. 3. The roll width of the horizontal rolls 30 of the universal roughing mill 22 was 408.5 mm, and the flange taper was 5 degrees. The dimensions of the resulting H-beam after intermediate rolling and finishing rolling are shown in the following table.

TABLE 1

| | Intermediate Rolling | Finishing Rolling |
|---|---|---|
| Web thickness | 11.5 mm | 11.1 mm |
| Flange thickness | 18.2 mm | |
| Flange width | 303 mm | |
| Web height Ho | 445 mm | 405 mm |
| Flange inner width Wo | 408.6 mm | 368.6 mm |

The dimensions for finishing rolling were the dimensions after three passes through a universal finishing mill having horizontal rolls with a width of 360 mm.

After finishing rolling the web thickness was 11.1 mm and the web height Ho was 405 mm. The flange inner width Wo was 368.6 mm, so the horizontal rolls and the inner surfaces of the flanges were separated by about 4 mm. However, by reducing the web height by roughly 40 mm using the vertical rolls, the outer surfaces of the flanges were made as straight as those of flanges formed using a conventional rolling method, and the flanges were perpendicular to the web. The borders between the section of the web which was reduced by the horizontal rolls and the section which was not reduced fell along the corners, so the borders were not prominent.

Based on these experimental data, the following discoveries were made.

(1) If the horizontal roll width of a universal finishing mill is 10–50 mm less than the horizontal roll width of a universal roughing mill, an intermediate rolled steel shape which was rolled in a universal roughing mill can be subjected to one or more passes through a universal finishing mill to reduce the web height Ho and obtain H-beams having different web heights.

(2) If the flange thickness is reduced to a target value in the universal roughing mill, it is not necessary to reduce the flanges during finishing rolling.

(3) The web height can be adjusted to any value regardless of the width of the horizontal rolls of the universal finishing mill, and a single universal finishing mill can manufacture many different sizes of H-beams having different web thicknesses, flange thicknesses, web heights, and flange widths.

(4) It has been thought that with conventional rolling methods, the flange inner width Wo of a rolled material could not be changed when using horizontal rolls having a given width. This is because it was thought that the flanges could not be made perpendicular to the web unless the lateral surfaces of the horizontal rolls contacted the inner surfaces of the flanges. However, if the horizontal roll width is decreased so that the lateral surface of the horizontal rolls does not contact the inner surfaces of the flanges and only the outer surfaces of the flanges are rolled, even if the web height is reduced, the flanges can be maintained perpendicular to the web, since the outer surfaces of the flanges contact the vertical rolls. Namely, the outer dimensions of the web height can be freely varied by up to several tens of mm by changing the separation between the vertical rolls.

(5) In a typical universal mill, the horizontal rolls are driven by a motor, while the vertical rolls are idling rolls. Therefore, when the flanges are not rolled, it is necessary to roll the web. As a result, a step is formed at the border between the section of the web which is reduced and the section which is not.

In the case of channels, however, this step is formed only on the inner surface of the web, since the horizontal roll for the outer surface of the web can be wide enough to prevent the formation of steps. Therefore, after welding channels together to form a box-shaped member, the steps in the inner surfaces of the webs are invisible and are not a serious problem.

(6) It is desirable to be able to vary the roll width of the horizontal rolls of a universal finishing mill. However, in a conventional universal roughing mill or universal finishing mill, a rolling load of over 100 tons acts on the rolls in the normal and axial directions, so it is difficult to vary the width of the horizontal rolls, and at present, variable-width rolls are not actually used. However, if all of the rolls in a universal mill stand having variable-width rolls are idling or else lightly driven, the web height of H-beams can be changed without imparting too great a load on the horizontal rolls, the flange thickness undergoes almost no reduction, and the drive force is provided almost entirely by a universal finishing mill adjoining the variable-width mill.

(7) In a conventional universal finishing mill, the rolling load on the horizontal rolls was above 100 tons when rolling members having a flange innner width Wo of 400 mm and above. However, if a universal shape-adjusting mill with idling variable-width rolls is placed near the universal finishing mill, the rolling load on the horizontal rolls can be reduced to below 50 tons. In experiments using actual rolls, the rolling load was reduced to a low value of 20–30 tons. A load of this level has no effect on the structure of the horizontal variable-width rolls.

The above-described findings (1)–(7) also apply to the rolling of channels or other steel shapes having parallel flanges.

In accordance with one mode of the present invention, a rolling method for parallel-flange steel shapes comprises the steps of rough rolling a rolling material in a breakdown mill to form a web and two flanges, performing intermediate rolling to reduce the flanges to substantially their final dimensions, and performing finish rolling in a universal finishing mill to reduce the web height by rolling the outer surfaces of the flanges with vertical rolls without the inner surfaces of the flanges contacting the lateral surfaces of the horizontal rolls of the universal finishing mill.

Two examples of parallel-flange steel shapes which can be formed by the method are channels and H-beams.

The horizontal rolls of the universal finishing mill may be variable-width rolls. This provides the advantage that the boundary between rolled and unrolled portions of the web can be made less prominent As in a conventional rolling method, a universal shape-adjusting mill or a roll straightener may be disposed on the exit side of the universal finishing mill to flatten the web by light rolling and to make the flanges perpendicular to the web. The universal shape-adjusting mill may have variable-width rolls.

In accordance with another mode of the present invention, a rolling method for parallel-flange steel shapes comprises the steps of rough rolling a rolling material in a breakdown mill to form a web and two flanges, performing intermediate rolling to reduce the flanges to substantially their final dimensions, performing finishing rolling of the web, and reducing the web height by rolling in a universal shape-adjusting mill whose rolls are all idling rolls and which has variable-width horizontal rolls.

If either the horizontal rolls and/or the vertical rolls of the idling universal mill are given an auxiliary drive force, the biting and releasing of the material being rolled can be made easier.

DESCRIPTION OF THE PREFERRED EMBODIMENTS

The present invention will now be described in greater detail while referring to the accompanying drawings.

Figure 8:
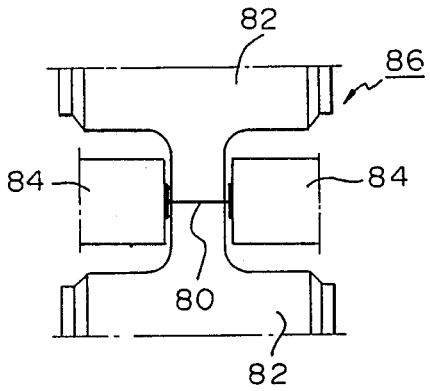
FIG. 8 is an end view of a universal finishing mill when performing rolling by the method of the present invention.

FIG. 8 is a schematic end view of a universal finishing mill for use in carrying out the method of the present invention. The method of the present invention will be described with respect to the manufacture of an H-beam, but the same explanation applies for other steel shapes having parallel flanges, such as channels.

In accordance with the rolling method of the present invention, breakdown rolling can be performed in the conventional manner to form a rolling material into a beam blank. In intermediate rolling, the flange inner width, the flange thickness, and the web thickness are reduced to their final dimensions.

The resulting rolled steel shape 80 is then rolled between the horizontal rolls 82 and the vertical rolls 84 of a finishing universal mill 86 to adjust the web height Ho. Namely, as shown in FIG. 8, by varying the separation between the vertical rolls 84, the web height of the H-beam can be freely varied by several centimeters. The size of the beam can therefore be varied without changing the rolls, so the present invention is suited to the rolling of steel shapes of many different sizes. The separation between the vertical rolls 84 can be changed in a short time during rolling.

Figure 9:
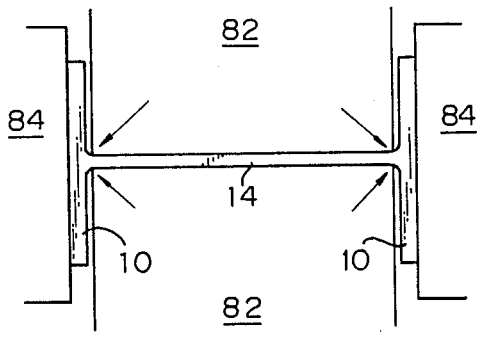
FIG. 9 is an enlargement of the central portion of FIG. 8.
Figure 10:
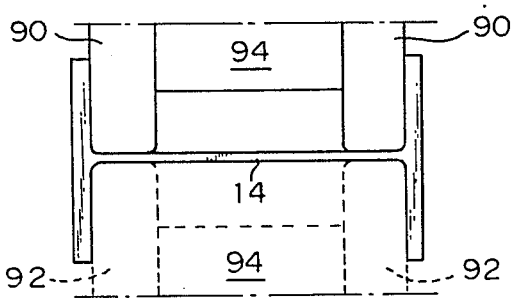
FIG. 10 is an end view of a universal finishing mill having segmented horizontal rolls.

FIG. 9 is an enlargement of the central portion of FIG. 8. The arrows in the figure show the boundaries between the rolled portions and the unrolled portions of the web 14. As steps are formed at the boundaries, it is desirable that the boundaries be as close to the corners as possible. If the range of variation of the web height Ho is large and the border of the rolled section falls in the flat portion of the web 14, the step will be prominent, and it will be necessary to remove the step by light rolling of the web in a mill which is provided downstream of the finishing mill. This light rolling can be performed using a special universal shape-adjusting mill. However, it is possible to reduce the step and flatten the web to within tolerances by using a roll straightener such as the roll strainer shown in FIG. 10. In the figure, a pair of upper and lower rolls 90 and 92 is disposed at each end of a web 14, and the rolls are pushed against the inner surfaces of the flanges 10 by spacers 94. If the width of the spacers 94 is changed, the same arrangement can be used for H-beams having different web heights.

Figure 1A:
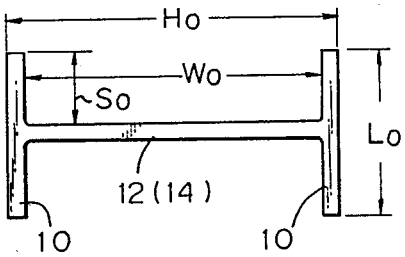
FIG. 1*a* is an end view of a conventional H-beam and FIG. 1*b* is an/end view of a conventional channel.
Figure 1B:
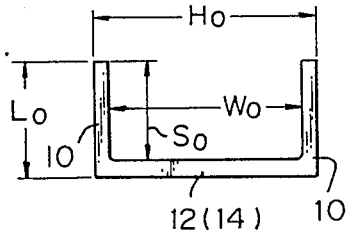
Figure 2:
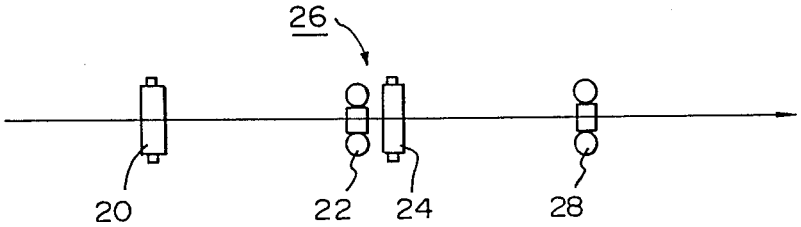
FIG. 2 is a schematic view of a conventional rolling line.
Figure 3:
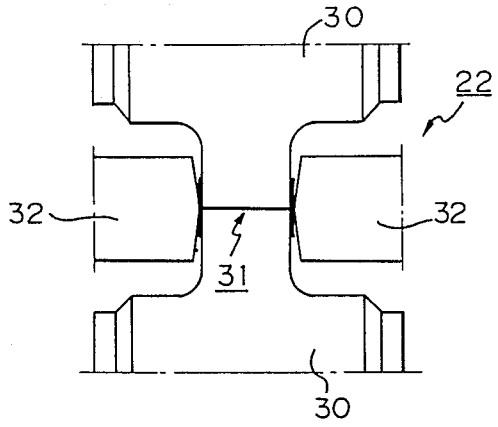
FIG. 3 is an end view of a universal roughing mill when rolling an H-beam.
Figure 4:
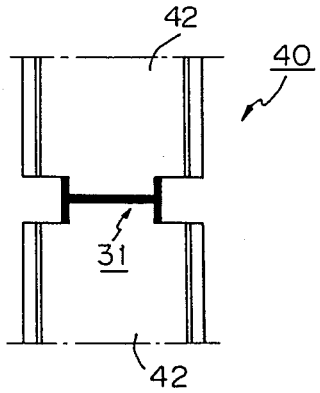
FIG. 4 is an end view of an edging mill when rolling an H-beam.
Figure 5:
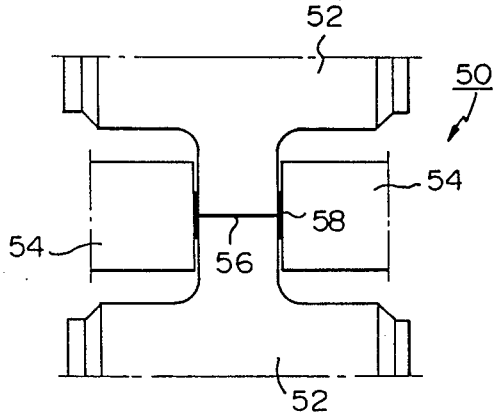
FIG. 5 is an end view of a universal finishing mill when rolling an H-beam.
Figure 6:
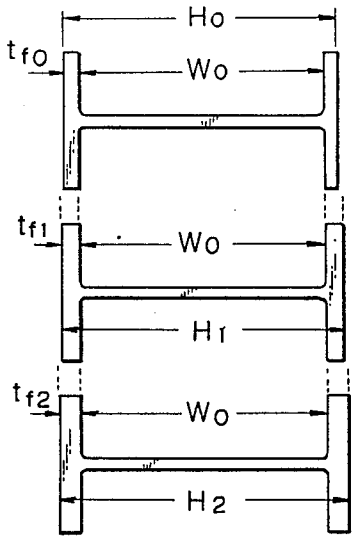
FIG. 6 is an end view of three different H-beams of the same series which were manufactured by a conventional rolling method.
Figure 7:
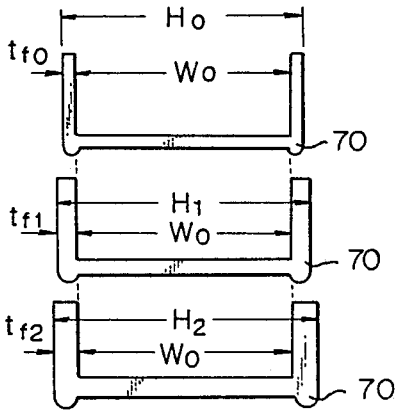
FIG. 7 is an end view of three different channels of the same series which were manufactured by a conventional rolling method.

When rolling channels, as shown in FIG. 7, bulges 70 are formed at the outer corners of the channels. However, the bulges 70 can be removed by a universal shape-adjusting mill or similar machine and the outer corners of the channels can be squared. If necessary, the outer corners can be chamfered in an edging mill or the like prior to rolling in a finishing mill.

In this manner, according to the present invention, H-beams and other steel shapes having parallel flanges can be manufactured extremely easily. When performing rolling by a conventional rolling method, in order to manufacture all of the 33 different types of H-beams which are prescribed by JIS, 33 types $\times 2$ rolls/type $=66$ horizontal rolls are necessary. However, if the web height is to be controlled between 0 and 50 mm in a universal finishing mill, only 12 types of horizontal rolls are necessary, resulting in a saving of 42 rolls.

There has long been a desire to manufacture H-beams such that different size beams in a single series had the same web height Ho but different flange thicknesses. However, using a conventional rolling method, it is necessary to use a different set of horizontal rolls for each beam size, so a large number of rolls are necessary and it is economically difficult to maintain a constant web height Ho for a single series. In accordance with the rolling method of the present invention, the web height can be freely adjusted in a finishing mill, so it is extremely easy to maintain the same web height for different size beams in the same series.

A channel can be rolled by the method of the present invention in the following manner. First, as in a conventional rolling method, a slab is rolled into the shape of a channel by multiple passes through a breakdown mill. Next, rolling is performed in a universal roughing mill having horizontal rolls with a width equal to the target flange inner width Wo of the smallest channel in the series, i.e., the channel having the thinnest flanges. As the same horizontal rolls are used for the entire series, after intermediate rolling, the larger channels in the series will have a flange inner width Wo which is larger than their target values. Rolling is then performed in a universal finishing mill having horizontal rolls with a width equal to the target flange inner width Wo of the largest channel in the series, i.e., the channel with the thickest flanges. If the flanges in a series of channel vary in thickness from 20 to 50 mm, the horizontal rolls of the universal roughing mill will be 60 mm wider than those of the universal finshing mill. During one or more passes through the universal finishing mill, the vertical rolls reduce the web height Ho to a uniform value for the entire series. The amount of reduction by the horizontal rolls in the universal finishing machine is preferably 1 mm or less.

Next, it is desirable to perform shape-adjusting to remove steps in the web and to square the outside corners. Namely, the inner and outer surfaces of the flange are not reduced, and the corners are squared by contact with only the vertical rolls. On the other hand, steps in the inner and outer surfaces of the web are removed by light rolling of the web, and the web is flattened. The outer corners of a channel are also squared so that no bulges are formed.

Flattening of the web and squaring of the corners can be performed by a universal shape-adjusting mill or a 2-high mill having variable-width horizontal rolls. As the rolling force in the axial direction of the horizontal rolls is nearly zero, the mechanism for adjusting the roll width can be extremely simple.

The preceding explanation was for the case in which the web height is adjusted in a universal finishing mill. However, the web thickness can also be adjusted by a universal shape-adjusting mill having idling rolls, or by a combination of such a universal shape-adjusting mill and a universal finishing mill.

In accordance with one mode of the present invention, roughing in a breakdown mill and intermediate rolling in a mill group comprising a universal mill and an edging mill are performed in a conventional manner, but subsequent rolling in a universal finishing mill and a universal shape-adjusting mill can be performed by either of the following two methods.

According to a first method, when rolling intermediate size steel shapes with a flange inner width of at least 200 mm for which the difference in flange thickness in a single series is no more than 5 mm, the horizontal roll width for the universal finishing mill is the same as for a conventional method. However, the width which is actually utilized can be more than twice as large as for a conventional method. In the universal finishing mill, in the same way as in the conventional method, the flanges of the material being rolled are reduced by the lateral surfaces of the horizontal rolls and the vertical rolls. The horizontal roll width of the universal shape-adjusting mill is changed for each size of beam so that the web height will always be the nominal dimensions (for example, 400 mm for an H 400×200 Series H-beam). The material which is rolled in the universal finishing mill is pushed into the universal shape-adjusting mill by the universal finishing mill. The web height is reduced by a maximum of 10 mm to the nominal dimensions. At this time, the inner surfaces of the flanges merely contact the lateral surfaces of the segmented horizontal rolls, and there is almost no rolling load applied in the direction normal to the flange surface.

A different mode of operation is employed when rolling a large-sized member with a flange inner width of greater than 300 mm or a nonstandard size in which the reduction of the web height is an extremely large value of 10"50 mm. In this case, it is impossible to reduce the web height using a universal shape-adjusting mill. First, a large portion of the reduction is carried out in a universal finishing mill, and then reduction by 0–10 mm is performed in the universal shape-adjusting mill. Namely, the horizontal roll width of the universal shape-adjusting mill is set in advance at a narrow value corresponding to the size of beam having the thickest flanges and a web height of nominal dimensions. The web is then rolled by the horizontal rolls by multiple passes in the universal finishing mill, while the vertical rolls roll the outer surfaces of the flanges and reduce the web height. Naturally, in each pass, there is a space between the inner surfaces of the flanges and the lateral surfaces of the horizontal rolls, as shown in FIGS. 8 and 9. After the final pass in the universal finishing mill, the reduction of the web height, i.e., shape-adjusting is simultaneously performed by the universal shape-adjusting mill. In this case, the force for rolling in the universal shape-adjusting mill is mainly provided by the motors for the universal finishing mill.

Figure 11:
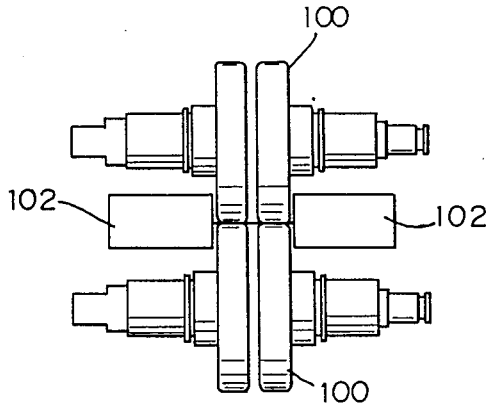
FIG. 11 is an end view of a universal shape-adjusting mill having idling rolls.
Figure 12:
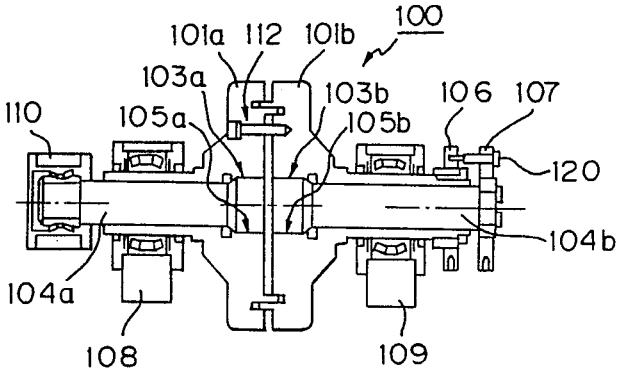
FIG. 12 is a cross-sectional view of a variable-width horizontal roll used in the mill of FIG. 11.

FIG. 11 is an end view of a universal shape-adjusting mill in which all the rolls are idling rolls and which has variable-width horizontal rolls. FIG. 12 is a cross-sectional view of one of the horizontal rolls of FIG. 11. This universal shape-adjusting mill is disposed near to the universal finishing mill on either the entrance or exit side. As shown in FIG. 11, the mill has upper and lower idling horizontal rolls 100 and two idling vertical rolls 102.

As shown in FIG. 12, each horizontal roll 100 is divided in the axial direction into two roll halves **101*a* and 101*b*. Each roll half has a bore at its center into which a shaft 104*a* or 104*b*, respectively, is inserted. Each shaft 104*a* and 104*b* has an external thread 105*a* and 105*b*, respectively, formed on one end. The external threads 105*a* and 105*b* engage with internal threads 103*a* and 103*b* formed in the bores of the two roll halves 101*a* and 101*b*, respectively. One of the internal threads is a left-hand thread, and the other is a right-hand thread. The roll halves 101*a* and 101*b* are rotatably supported by bearings 108 and 109, respectively. Positioning disks 106 and 107 are mounted on the end of roll half 101*b* and on the end of shaft 104*b*, respectively. An axial positioning apparatus 110 is mounted on the end of shaft 104*a***.

The disks 106 and 107 can be connected with one another by a connecting pin 120. When the two disks are disconnected, if disk 106 is rotated with respect to disk 107, roll half **101*b* will rotate with respect to shaft 105*b*, and the engagement between external thread 105*b* and internal thread 103*b* will cause roll half 104*b* to translate in the axial direction of shaft 104*b*. The rotation of roll half 101*b* is transmitted to roll half 101*a* by a pin 112 which can slide axially inside roll half 101*a*, so roll half 101*a* will be moved axially by the same amount as roll half 101*b* but in the opposite direction. After the axial positions of the roll halves have been adjusted, the two disks 106 and 107 are connected by pin 120** to prevent their relative rotation and the axial movement of the roll halves. In this manner, the separation of the roll halves can be easily adjusted.

The axial positioning of the roll halves can be performed manually, but if a motor is provided for rotating the disks 106 and 107 with respect to one another, positioning can be performed by remote control.

The method of the present invention will now be described in greater detail by means of the following working examples.

EXAMPLE 1

Figure 13:
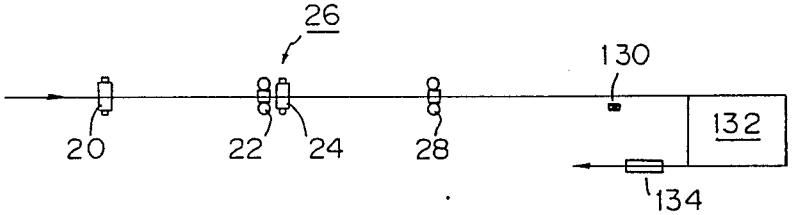
FIG. 13 and FIG. 14 are schematic illustrations of a rolling mill layout for carrying out the method of the present invention.

In this example, H-beams were rolled using the rolling stand layout illustrated in FIG. 13. After being heated, a rolling material such as a CC bloom or a slab was formed into a beam blank having a shape close to that of an H-beam by multiple passes through a breakdown (BD) mill 20. Next, in a universal roughing mill group 26 consisting of a universal roughing (UR) mill 22 having horizontal rolls with a width of 408.5 mm and an edging (E) mill 24, intermediate rolling of an H 450×300 H-beam was carried out. At this time, the taper of the lateral surfaces of the horizontal rolls was the same 0.3 degrees as for a conventional finishing mill. When manufacturing H 450×300 H-beams, the H-beam was passed through the universal finishing (UF) mill 28 without any load being applied to the beam.

Next, when rolling an H 400×300 H-beam using the same rolling line, after varying the web thickness, the flange thickness, and the flange inner width, the web height was reduced by approximately 50 mm by three passes in the universal finishing mill 28 and a final product was obtained.

This series has the two sizes H 386×299×9/14 and H 390×300×10/14, but if the user desires, it is easy to manufacture H-beams having nominal dimensions of H 400×299×9/14 or H 400×300×10/16. Furthermore, if the web height is between 400 and 450 mm, the web height can be adjusted to any value. If the web height is less than 400 mm or greater than 450 mm, the web height can be varied by up to 50 mm.

Figure 14:
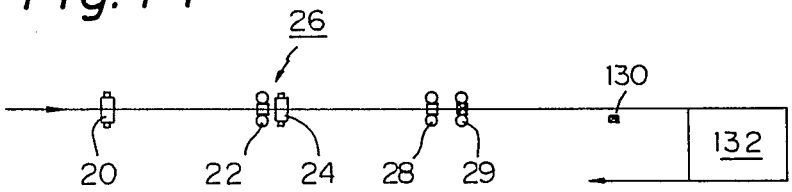

FIG. 14 shows a rolling mill layout which differs from that of FIG. 13 in that a universal shape-adjusting mill 29 having variable-width horizontal rolls with segmented sleeves is disposed on the exit side of the universal finishing mill 28, although it could instead be disposed on the entrance side. In this mill 29, the inner and outer surfaces of the flanges are not reduced and merely contact the rolls, while the web is subject only to light rolling in order to remove steps in the web which were formed in the universal finishing mill 28. The rolling line of FIG. 14 can produce H-beams of higher quality.

A universal finishing roll performs reduction using vertical rolls. It is therefore difficult to employ variable-width rolls in a universal finishing mill. In the present invention, the web height is adjusted in a universal finishing mill, and variable-width rolls are employed only in a shape-adjusting mill in which there is no axial force applied to the horizontal rolls. As a result, the present invention makes it possible to perform variable-width rolling.

As shown in FIG. 13, instead of using a shape-adjusting mill, it is possible to accomplish the same objective by using a roll straightener such as a roll strainer.

In FIGS. 13 and 14, reference FIG. 130 shows a hot saw, 132 is a cooling bed and 134 is a roll strainer.

EXAMPLE 2

In this example, parallel-flange channels were manufactured using a rolling line having the mill layout illustrated in FIG. 14.

As an example, for a 500×250 channel, the thickness was varied between 13 and 50 mm. The width of the horizontal rolls of the universal roughing mill 22 was 474 mm. After 7 passes through the roughing mill 22, the flange thickness and the web thickness were both reduced to 13.1 mm. The taper of the lateral faces of the horizontal rolls was 0.3 degrees. The grooves of the edging mill were selected so as to square the outer corners between the flanges and the web. When rolling a channel with the minimum thickness of 13 mm, the channels merely touched the rolls of the universal finishing mill 28 without being reduced. After finishing, the channels were rolled in the same manner with a universal shape-adjusting mill 29 having variable-width horizontal rolls.

When rolling a channel with a moderate thickness of 30 mm, after rolling in the universal roughing mill group 26, the finished dimensions of the channel were a flange thickness of 30.3 mm, a web thickness of 30.9 mm, and a web height of 534.6 mm. The grooves in the edging mill were shaped so as to chamfer the outer corners of the channels. In the universal finishing mill, the web height was reduced by 0.6 mm per pass to a final web height of 500 mm. At this time, the inner surfaces of the flanges and the lateral surfaces of the horizontal rolls were separated by 19.8 mm on each side. The flange inner width Wo of the channel was 439.6 mm, and the width of the lower horizontal roll of the universal finishing mill was 400 mm. The channel was next rolled in a universal shape-adjusting mill having a variable-width upper roll which was adjusted to a width of 439.6 mm. As when rolling the 13-mm channel, the 30-mm channel was passed through the shape-adjusting mill with the flanges merely touching the rolls, while the web was flattened by light rolling.

When rolling the largest channel having a thickness of 50 mm, the dimensions of the channel after leaving the universal roughing mill were a flange thickness of 50.5 mm, a web thickness of 51.0 mm, and a web height of 575 mm. After 3 passes through the universal finishing mill 28, the web height was reduced to 500 mm. At this time, the amount of reduction of the web was 0.2 mm per pass.

Next, shape-adjusting was performed in the universal shape-adjusting mill 29. The horizontal roll width was changed to 400 mm, and the corners were squared and the web was flattened.

Figure 15:
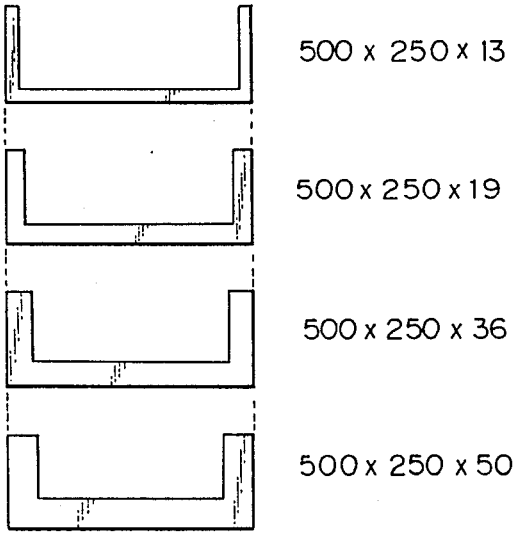
FIG. 15 is an end view of four different channels of the same series which were manufactured by the method of the present invention.

The shapes of a series of channels which were manufactured in this manner are illustrated in FIG. 15. It can be seen that the web height was maintained constant at 500 mm while the flange thickness was gradually changed.

When the surface shape and dimensional tolerances are not critical, it is not necessary to employ the universal shape-adjusting mill 29. In addition, when reverse rolling is performed in the universal finishing mill 28, the universal shape-adjusting mill can be disposed near to the entrance side of the universal finishing mill.

EXAMPLE 3

In this example, a rolling line having the mill layout illustrated in FIG. 14 was used to manufacture H-beams by the method of the present invention.

(1) Manufacture of H 400×200 Series H-Beams

A continuously cast bloom (300 mm thick ×670 mm wide) was heated to 1250° C. in a heating furnace. Next, 17 passes of reverse rolling were performed in a breakdown mill 20 having grooved rolls, and beam blanks having a web thickness of 40 mm were manufactured. There are three sizes of JIS H 400×200 series H-beams: H 396×199×7/11, H 400×200×8/13, and H 404×201×9/15. Each size has a flange inner width Wo of 374 mm.

The horizontal roll width in the universal roughing mill 22 was maintained at a conventional value. In 7 passes, H-beams having dimensions close to those given above were formed. In the universal roughing - edging mill group 26, the flanges had a taper of 5 degrees. The universal finishing mill 28 had conventional horizontal rolls. The flange taper in the universal finishing mill 28 was 0.3 degrees, and nearly the above-listed dimensions were reached. In a universal shape-adjusting mill 29 with idling rolls, the width of the horizontal rolls was changed during rolling for each size of beam. For the H 396×199×7/11 H-beams, the horizontal roll width was 374 mm in the universal finishing mill 28 and 378 mm in the universal shape-adjusting mill 29. For the H 400×200 ×8/13 H-beam, the horizontal roll width was 374 mm for both the universal roughing and the universal finishing mills, and almost no reduction was performed in the universal shape-adjusting mill 29. For the H 404×201×9/15 H-beam, the horizontal roll width was 370 mm in the universal shape-adjusting mill 29. The beam was pushed through the shape-adjusting mill 29 by the finishing mill 28. Due to the reduction of the web thickness in the universal shaping mill 29, the usable width of the horizontal rolls in the universal roughing mill and the universal finishing mill was increased from about 6 mm to over 10 mm, resulting in a great decrease in the total cost of rolls.

(2) Manufacture of H 900×300 Series H-Beams

This series has four sizes ranging from H 890×299×15/23 to H 918×303×19/37. The difference in the flange thickness between the smallest and largest sizes is 14 mm, and the difference in web height is 28 mm. It is difficult to reduce the web height to 900 mm in a single pass. The horizontal roll width of the universal finishing mill 28 was reduced by roughly 18 mm from a conventional value of 844 mm to 826 mm. On the other hand, the horizontal roll width of the universal roughing mill 22 was increased to 854 mm. When rolling the 15/23 size, the web height Ho was 854+23+23=900 mm at the center of the flanges. Therefore, the separation between the vertical rolls of the universal finishing mill 28 was set at 900 mm and rolling was performed with no contact between the inner surfaces of the flanges and the sides of the horizontal rolls, and the beam was pushed into the universal shape-adjusting mill 29. The horizontal roll width in the universal shape-adjusting mill 29 was 854 mm, and the inner and outer surfaces of the flanges were shaped by contact with the rolls. For the 19/37 size, the web height upon leaving the universal finishing mill was 928 mm. The web height was reduced to 900 mm by three passes through the universal finishing mill 28. During the third pass, the beam contacted the side walls of the horizontal rolls. The roll width of the nondriven universal shape-adjusting mill 29 was 826 mm. The beam was pushed through the universal shape-adjusting mill by the universal finishing mill, and final dimensions of H 900×303×19/37 were obtained.

As described above, in accordance with the method of the present invention, it is possible to manufacture an entire series of steel shapes having a uniform web height by using only a single set of horizontal rolls. Furthermore, by using a universal shape-adjusting mill, it is possible to form channels having square corners without bulges. In addition, it is possible to manufacture nonstandard shapes at a low cost.

Furthermore, by using the power of a universal finishing mill to push a steel shape through a universal shape-adjusting mill having variable-width horizontal rolls which are idling or provided only an auxiliary drive force, the web height of H-beams can be freely adjusted regardless of the horizontal roll width in a single rolling chance using a single set of rolls. Therefore, the number of rolls which must be maintained is greatly decreased, and the yield per roll is greatly increased.

What is claimed is:

1. A rolling method for parallel-flange steel shapes comprising:

rough rolling a rolling material in a breakdown mill so as to form a web and two flanges connected to ends of the web;

performing intermediate rolling so as to reduce the flanges to substantially their final dimensions; and performing finishing rolling in universal finishing mill so as to reduce web height between outer surfaces of the flanges by rolling the outer surfaces of the flanges with vertical rolls without inner surfaces of the flanges contacting lateral surfaces of horizontal rolls of the universal finishing mill.

2. A rolling method as claimed in claim 1, wherein said steel shape is a parallel-flange channel.

3. A rolling method as claimed in claim 1, wherein said steel shape is an H-beam.

4. A rolling method as claimed in claim 1, wherein the universal finishing mill has variable-width horizontal rolls.

5. A rolling method as claimed in claim 1, further comprising a step of lightly rolling fillets between the flanges and the web and making the flanges perpendicular to the web using a universal shape-adjusting mill disposed on an exit side of the universal finishing mill.

6. A rolling method as claimed in claim 5, wherein the universal shape-adjusting mill has variable-width horizontal rolls.

7. A rolling method as claimed in claim 1, wherein each of the flanges has a flange thickness between inner and outer surfaces thereof, the flange thickness being reduced by the step of intermediate rolling but not being reduced substantially in the step of finishing rolling.

8. A rolling method for parallel-flange steel shapes comprising:

rough rolling a rolling material in a breakdown mill so as to form a web and two flanges connected to ends of the web;

performing intermediate rolling so as to reduce the flanges to substantially their final dimensions;

performing finishing rolling of the web; and reducing web height between outer surfaces of the flanges by rolling in a universal shape-adjusting mill whose rolls are all idling rolls and which has variable-width horizontal rolls.

9. A rolling method as claimed in claim 8, wherein said steel shape is a parallel-flange channel.

10. A rolling method as claimed in claim 8, wherein said steel shape is an H-beam.

11. A rolling method as claimed in claim 8, wherein the finishing rolling in the universal finishing mill is performed so as to reduce the web height by rolling the outer surfaces of the flanges with vertical rolls without inner surfaces of the flanges contacting lateral surfaces of horizontal rolls of the universal finishing mill.

12. A rolling method as claimed in claim 8, wherein the finishing rolling in the universal finishing mill is performed so as to reduce the web height by rolling the outer surfaces of the flanges with vertical rolls with inner surfaces of the flanges contacting lateral surfaces of horizontal rolls of the universal finishing mill.

13. A rolling method as claimed in claim 8, wherein each of the flanges has a flange thickness between inner and outer surfaces thereof, the flange thickness being reduced by the step of intermediate rolling but not being reduced in the step of reducing the web height by the universal shape-adjusting mill.

14. A rolling method as claimed in claim 8, wherein the steel shape is pushed into the universal shape-adjusting mill by the universal finishing mill.

15. A rolling method for parallel-flange steel shapes comprising:

rough rolling a rolling material in a breakdown mill so as to form a web and two flanges connected to ends of the web;

performing intermediate rolling so as to reduce the flanges to substantially their final dimensions;

performing finishing rolling of the web; and reducing web height between outer surfaces of the flanges by rolling in a universal shape-adjusting mill which has variable-width horizontal rolls, at least one of the horizontal rolls and vertical rolls of said universal mill being provided an auxiliary drive force.

16. A rolling method as claimed in claim 15, wherein the finishing rolling in the universal finishing mill is performed so as to reduce the web height by rolling the outer surfaces of the flanges with vertical rolls without inner surfaces of the flanges contacting lateral surfaces of horizontal rolls of the universal finishing mill.

17. A rolling method as claimed in claim 15, wherein the finishing rolling in the universal finishing mill is performed so as to reduce the web height by rolling the outer surfaces of the flanges with vertical rolls with inner surfaces of the flanges contacting lateral surfaces of horizontal rolls of the universal finishing mill.

18. A rolling method as claimed in claim 15, wherein each of the flanges has a flange thickness between inner and outer surfaces thereof, the flange thickness being reduced by the step of intermediate rolling but not being reduced in the step of reducing the web height by the universal shape-adjusting mill.

19. A rolling method as claimed in claim 15, wherein the steel shape is pushed into the universal shape-adjusting mill by the universal finishing mill.

* * * * *